US009840847B2

(12) United States Patent
Bergmeyer

(10) Patent No.: US 9,840,847 B2
(45) Date of Patent: Dec. 12, 2017

(54) CURVED STAIRCASE

(71) Applicant: Moritz O. Bergmeyer, Jackson, WY (US)

(72) Inventor: Moritz O. Bergmeyer, Jackson, WY (US)

( * ) Notice: Subject to any disclaimer, the term of this patent is extended or adjusted under 35 U.S.C. 154(b) by 0 days.

(21) Appl. No.: 15/256,268

(22) Filed: Sep. 2, 2016

(65) Prior Publication Data

US 2017/0058533 A1 Mar. 2, 2017

Related U.S. Application Data

(60) Provisional application No. 62/213,237, filed on Sep. 2, 2015.

(51) Int. Cl.

| | |
|---|---|
| ***E04F 11/035*** | (2006.01) |
| ***E04F 11/09*** | (2006.01) |
| ***E04F 11/022*** | (2006.01) |
| *E04F 11/02* | (2006.01) |
| *E04B 1/32* | (2006.01) |

(52) U.S. Cl.

CPC ..... *E04F 11/035* (2013.01); *E04F 11/02* (2013.01); *E04F 11/022* (2013.01); *E04F 11/09* (2013.01); *E04B 2001/3247* (2013.01); *E04F 2011/0203* (2013.01); *E04F 2011/0209* (2013.01)

(58) Field of Classification Search

CPC ..... E04F 11/02; E04F 11/022; E04F 11/035; E04F 11/032; E04F 2011/0203; E04B 2001/3247

USPC ..... 52/187

See application file for complete search history.

(56) References Cited

U.S. PATENT DOCUMENTS

| | | | | |
|---|---|---|---|---|
| 116,441 | A * | 6/1871 | Henley | E04F 11/032 52/187 |
| 1,716,713 | A * | 6/1929 | Van Rossum | E04F 11/032 52/187 |
| 3,207,259 | A | 9/1965 | Gebhart | |
| 3,491,498 | A | 1/1970 | Hughes, Jr. | |
| 3,616,585 | A * | 11/1971 | Cirgenski et al. | E04F 11/025 52/187 |
| 3,667,176 | A | 6/1972 | MacKay | |

(Continued)

OTHER PUBLICATIONS

Stair Porn, Lightweight Helical, http://www.stairpom.org/2011/02/09/lightweight-helical/, Feb. 9, 2011.

(Continued)

*Primary Examiner* — Robert Canfield
*Assistant Examiner* — Matthew Gitlin
(74) *Attorney, Agent, or Firm* — Schmeiser, Olsen & Watts LLP

(57) ABSTRACT

A curved staircase including a double helix form with no center support column includes a plurality of stair segments, wherein each of the stair segments is formed from a plurality of rods coupled to a plurality of connecting nodes. The plurality of rods are arranged in a skewed tetrahedral geometry, which causes the plurality of stair segments to form a helical structure when the plurality of stair segments are coupled together. The plurality of rods form a spine on an underside of the plurality of stair segments. A tread is coupled to each of the stair segments. In alternate embodiments, the curved staircase may be formed from sheet metal creased to form a plurality of linear support locations and connecting nodes.

20 Claims, 13 Drawing Sheets

(56) References Cited

U.S. PATENT DOCUMENTS

| | | | | | |
|---|---|---|---|---|---|
| 3,740,906 | A | * | 6/1973 | Schneider | E04F 11/032 52/187 |
| 3,964,222 | A | * | 6/1976 | Geleijnse | E04F 11/032 52/187 |
| 4,041,662 | A | * | 8/1977 | Ward | E04F 11/038 52/182 |
| 4,128,976 | A | * | 12/1978 | Classen | E04F 11/032 52/187 |
| 4,296,577 | A | | 10/1981 | Schuette | |
| 4,373,609 | A | | 2/1983 | DeDonato | |
| 4,527,367 | A | | 7/1985 | Morellini | |
| 4,557,085 | A | | 12/1985 | Yamazaki | |
| 4,619,084 | A | | 10/1986 | Snitman | |
| 4,829,739 | A | * | 5/1989 | Coppa | B64G 9/00 403/171 |
| 4,831,706 | A | | 5/1989 | Short | |
| 5,058,339 | A | | 10/1991 | Krstovic | |
| 5,134,820 | A | | 8/1992 | Liu | |
| 5,218,796 | A | | 6/1993 | McCullough et al. | |
| 5,475,954 | A | | 12/1995 | Molinazzi | |
| 5,632,124 | A | | 5/1997 | Weingarten et al. | |
| 5,720,136 | A | * | 2/1998 | Turner | E04F 11/02 52/182 |
| 6,112,480 | A | | 9/2000 | Turner | |
| 6,688,055 | B2 | | 2/2004 | Lindsley | |
| 6,931,812 | B1 | | 8/2005 | Lipscomb | |
| 7,469,516 | B2 | | 12/2008 | Smith | |
| 7,946,084 | B2 | | 5/2011 | Gibson | |
| 2005/0097835 | A1 | | 5/2005 | Nishimoto et al. | |

OTHER PUBLICATIONS

The Loretto Chapel, Two myteries surround spiral staircase in the Loretto Chapel: the identity of its builder and the physics of its construction, http://www.lorettochapel.com/staircase.html, 2014.

Houzz, 16,436 free floating spiral helix staircase cus Please Staircase Design Photos, http://www.houzz.com/photos/staircase/free-floating-spiral-helix-staircase-cus-, 2016.

* cited by examiner

CURVED STAIRCASE

CROSS REFERENCE TO RELATED APPLICATION

This application claims priority to U.S. Patent Application Ser. No. 62/213,237 to Moritz O. Bergmeyer entitled "SPIRAL STAIRCASE", filed Sep. 2, 2015, the disclosure of which is hereby incorporated entirely herein by reference.

BACKGROUND OF THE INVENTION

Technical Field

This invention relates to a self-supporting curved staircase having a tetrahedral support structure.

State of the Art

Buildings all over the world incorporate spiral or curved staircases for their space savings and aesthetic appeal. However, spiral staircases often require a central column for support which makes them look like the scaffolding to build the stair was left in place.

While there are spiral or curved staircases that do not require a central column, these large double helix stairs are very expensive to build due to very heavy structural elements. Alternatively, they are often built using a curved wall for support.

A more natural light weight structure which imitates to some degree structures found in nature or crystals is a better solution. With the ability of bigger and faster computers, highly redundant structures as here proposed are able to be analyzed to meet building codes for strength and earthquake resistance that could not have been analyzed effectively even 40 years ago.

While there are many patents for circular staircases, most of them are similar to U.S. Pat. No. 3,667,176 issued to Donald R. H. Mackay, entitled Spiral Staircases and which discloses a spiral staircase having a rod through the center of the spiral in order to support the stairs.

Additional patents disclose self-supporting spiral or curved staircases, such as U.S. Pat. No. 6,112,480 issued to Scott A. Turner, entitled Modular Staircase. While this patent discloses, a self-supporting staircase, its design is very bulky and unattractive.

Accordingly, what is needed is a self-supporting curved staircase that is strong and aesthetically pleasing.

DISCLOSURE OF THE INVENTION

The disclosed invention relates to a self-supporting curved staircase having a tetrahedral support structure.

An embodiment of self-supporting curved staircase may include a plurality of stair segments, wherein each of the stair segments includes a plurality of rods coupled to a plurality of connecting nodes. The plurality of rods are arranged in a skewed tetrahedral geometry. The skewed tetrahedral geometry causes the plurality of stair segments to form a curved structure when the plurality of stair segments are coupled together. The plurality of rods form a spine on an underside of the plurality of stair segments. Treads are coupled to each of the stair segments.

An additional embodiment of self-supporting curved staircase may include a support structure, wherein the support structure comprises a plurality of segments having at least 9 rods coupled to at least 3 connecting nodes. The at least 9 rods and the at least 3 connecting nodes form a tetrahedral geometry. The tetrahedral geometry causes each of the plurality of segments to have a non-symmetrical shape. When the plurality of segments are coupled together the non-symmetrical shape causes the plurality of segments to form a helical support structure. A plurality of treads are coupled to the support structure.

A further embodiment of a self-supporting curved staircase may include a support structure comprising a plurality of linear support locations coupled at a plurality of connecting nodes. The plurality of linear support locations and the plurality of connecting nodes form a plurality of tetrahedrons. The plurality of linear support locations and the plurality of connecting nodes also form a spine on an underside of the self-supporting curved staircase. A plurality of treads are coupled to the support structure.

The foregoing and other features and advantages of the invention will be apparent to those of ordinary skill in the art from the following more particular description of the invention and the accompanying drawings.

BRIEF DESCRIPTION OF THE DRAWINGS

In order that the invention may be clearly understood, it will now be described by way of example with reference to the accompanying drawings, wherein.

DETAILED DESCRIPTION OF THE INVENTION

As discussed above, embodiments of the present invention relate to a self-supporting curved staircase including a curved form such as a winder form, helical or double helix form with no center support column or the like. The curved staircase is supported by a three dimensional curved space frame having a tetrahedral geometric structure.

Tetrahedral structures are described herein for support of a curved staircase. Sweeping larger diameter stairs may use a modified tetrahedron structure for support. The curved staircase structure as described herein may be analyzed for structural and earthquake stability and strength requirements. Further, the described curved staircase is efficient, lightweight and aesthetically pleasing.

For the purposes of this application, the following definitions will apply. A tetrahedron is a 3 dimensional object having four triangular faces; a triangular pyramid. Tetrahedral means pertaining to or having the form of a tetrahedron. Helical means having the shape or form of a helix. Double helix means a pair of parallel helices intertwined about a common axis.

Figure 1:
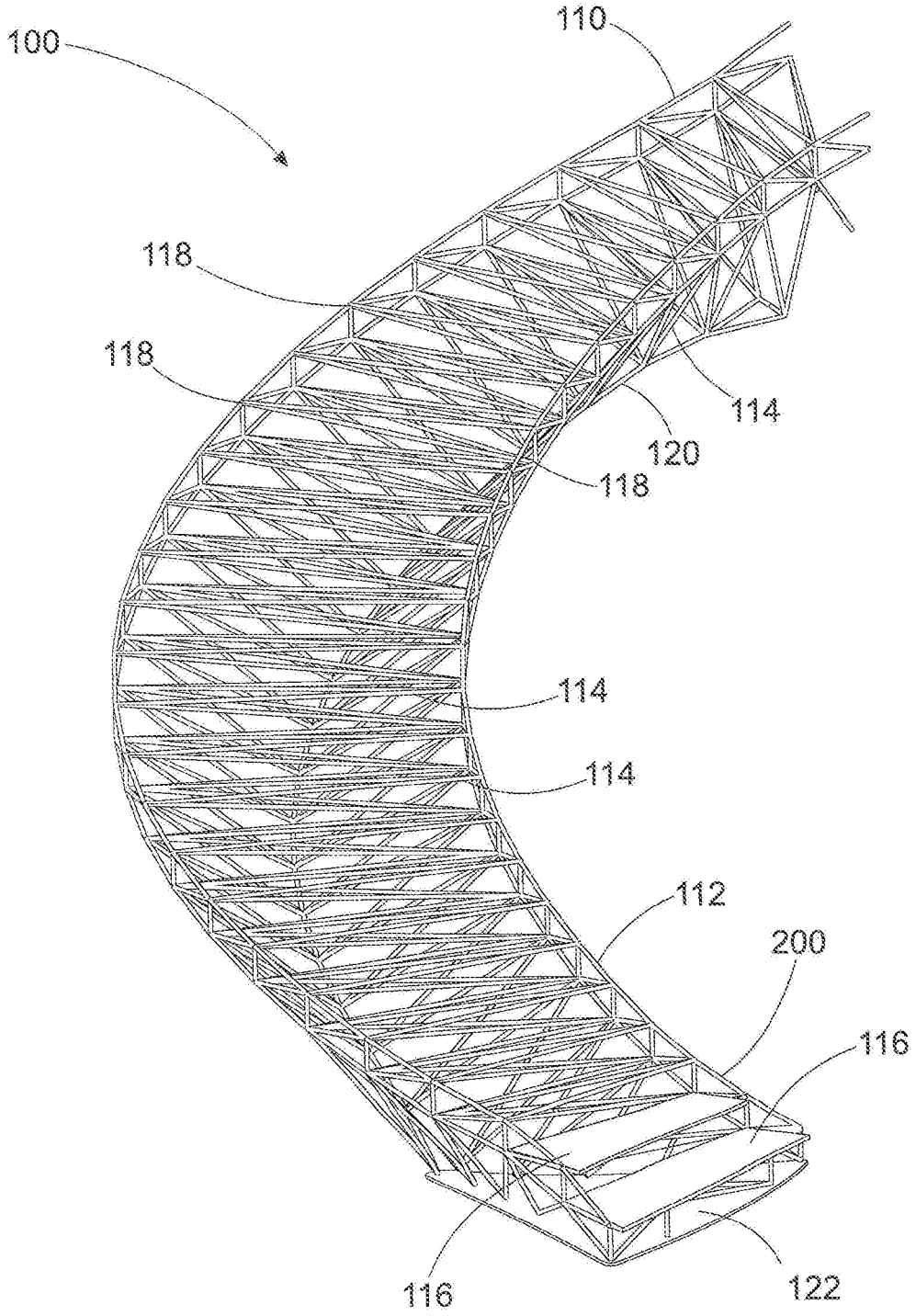
FIG. 1 is an isometric view of a first embodiment of a self-supporting curved staircase structure.
Figure 2:
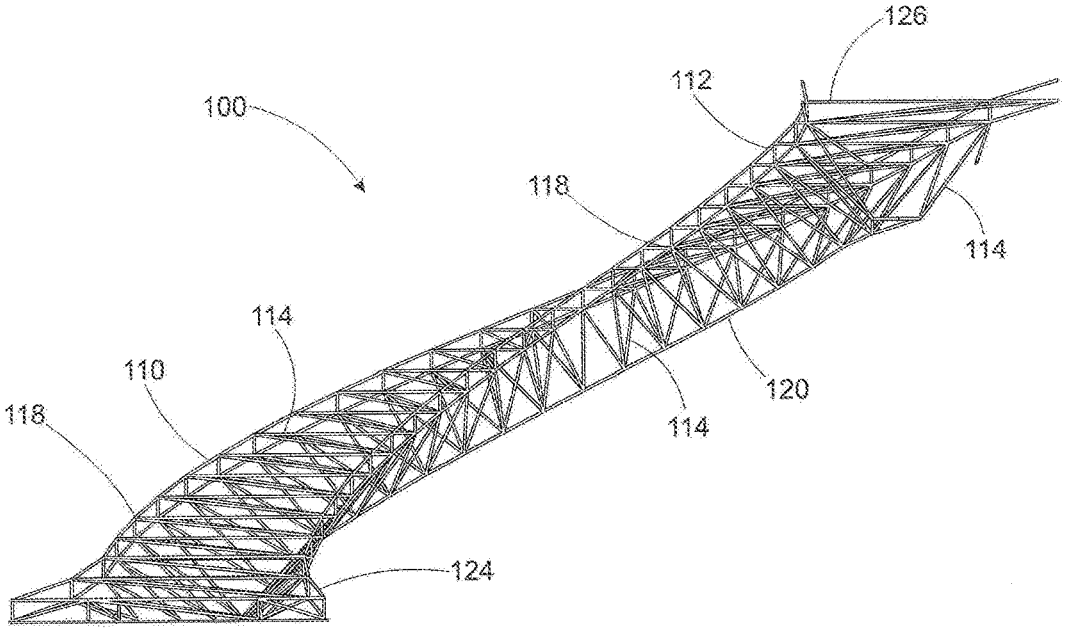
FIG. 2 is a side view of a first embodiment of a self-supporting curved staircase structure.
Figure 3:
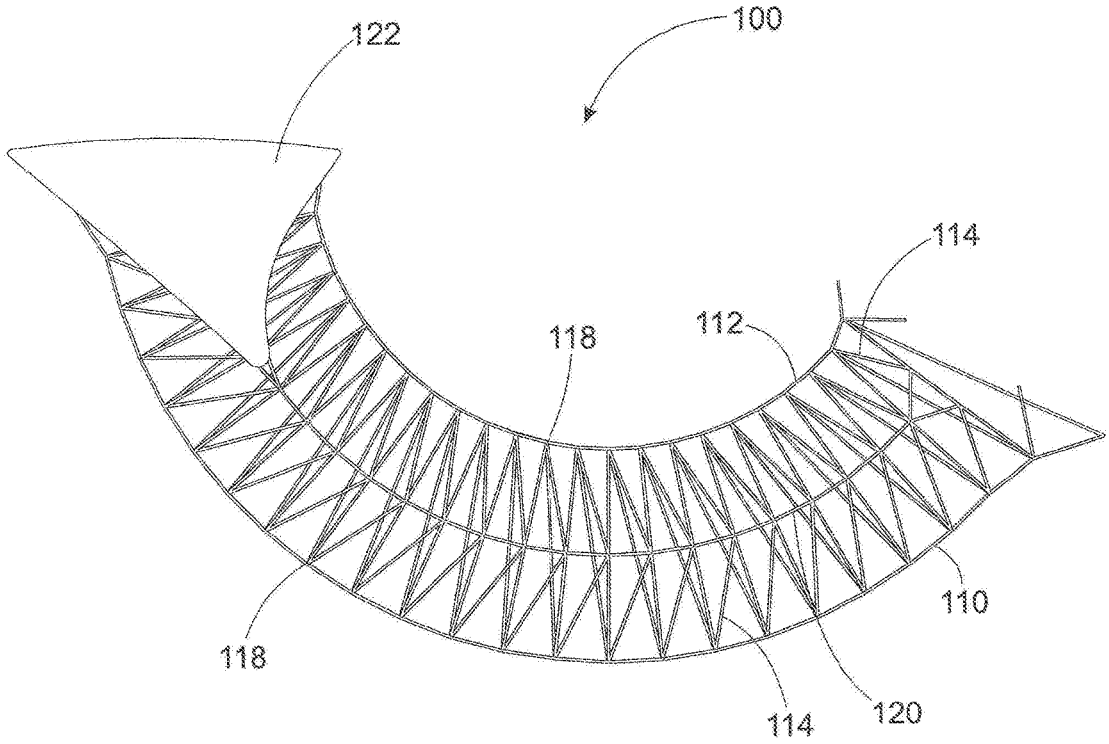
FIG. 3 is a bottom view of a first embodiment of a self-supporting curved staircase structure.

FIGS. 1-3 illustrate an embodiment of a self-supporting curved staircase structure 100 for use with large outside diameter curved stairs, particularly an outside diameter in the range of about 5 feet to about 30 feet or more. With larger outside diameter curved stairs, there is a need for more structural stability and less vibration of the support structure.

The self-supporting curved staircase structure 100 is formed from multiple stair segments 200 coupled together so as to form a helical staircase or double helix shape. The stair segments 200 are a stair step section that holds a single tread. The stair segments 200 are coupled front to back in order to form a full staircase. The front of the next stair segment 200 is coupled to the back of the previous stair segment 200.

Each stair segment 200 is formed from multiple support rods 114. Support rods 114 are illustrated as thin rods formed from metal or other strong, durable material. Support rods 114 may be any shape or size desired. They may be formed as thin rods as illustrated or they may be formed as flat strips of metal, hollow tubes, wooden dowels, polycarbonate rods, creases in sheet metal or the like. Provided that the support rods 114, are strong enough to support the curved staircase 100.

Each support rod 114 may be formed as a single piece or may be multiple pieces coupled together via welding, adhesive, male/female connector or the like. It is anticipated, however, that forming the support rods 114 as a single piece will provide the most strength to the curved staircase 100.

In the embodiment of the curved staircase 100 illustrated in FIGS. 1-3, there are 18 support rods 114 for each stair segment 200. In alternate embodiments of the curved staircase 100, there may be more or fewer support rods 114.

The support rods 114 are connected together at nodes 118. Nodes 118 are connection locations for multiple support rods 114. The nodes 118 may be formed by welding multiple support rods 114 together, or else the nodes 118 may have threaded, clip, compression or other connections in order to connect the support rods 114 together.

In the embodiment of the curved staircase 100, there are illustrated 5 nodes 118 for each stair segment 200.

The support rods 114 and the nodes 118 are arranged so as to create a tetrahedral geometry or in other words, they are arranged so as to form multiple tetrahedrons. The tetrahedrons utilized in the self-supporting curved staircase are skewed or modified in order to cause the staircase to form a helical arrangement or a double helix. The skewed tetrahedrons cause the stair segments 200 to have a non-symmetrical geometry which, when multiple stair segments 200 are coupled adjacent one another, causes the staircase to turn and form a double helix. Additionally, the support rods 114 and the nodes 118 are arranged so as to create a spine 120 which runs along the middle underside of the curved staircase structure 100 adding additional strength. The spine 120 is a line of support rods 114 with node 118 intersections that are arranged so as to create a line that follows the curve of the curved staircase 100.

Each stair segment 200 has a tread 116 placed on top of the top of the stair segment 200. The treads 116 are where the user will step as he/she ascends or descends the curved staircase 100. The treads 116 may be formed from any material desirable, including wood, marble, stone, metal, glass or the like. The treads 116 may be formed in any size or shape desirable. They may be formed as squares, rectangles, ovals, rounded rectangles or the like. However, the treads 116 must fit in the space provided on the stair segment 200. Additionally, the treads 116 should be strong enough to support the weight of a user and lightweight enough to not add significant stress to the staircase support 100.

Treads 116 are coupled to the underlying staircase support structure 100. Treads 116 may be coupled to the support structure 100 using bolts, screws, nails, adhesive, welding, or the like. The treads 116 may appear to be floating on the structure or fit tight to the corners of the structure.

The inner and outer edges of the curved staircase structure 100 each have a cheek which rises above the level of the tread 116. The inner cheek 112 is on the inside of the curved staircase 100 curve. The outer cheek 110 is on the outside of the curved staircase 100 curve. The inner cheek 112 and the outer cheek 110 are formed from multiple support rods 114 coupled with nodes 118. The cheeks 112 and 110 provide additional strength and support to the curved staircase 100. Additionally, they provide a location for balusters or the like to be coupled to the curved staircase 100.

FIGS. 1-3 also illustrate a bottom support plate 122. The bottom support plate 122 is a piece of sheet metal or other strong material which is coupled to the lower end of the curved staircase 100. The bottom support plate 122 is also coupled to the floor of the building the curved staircase 100 is installed in. The bottom support plate 122 may be formed in any size or shape desired.

Figure 5A:
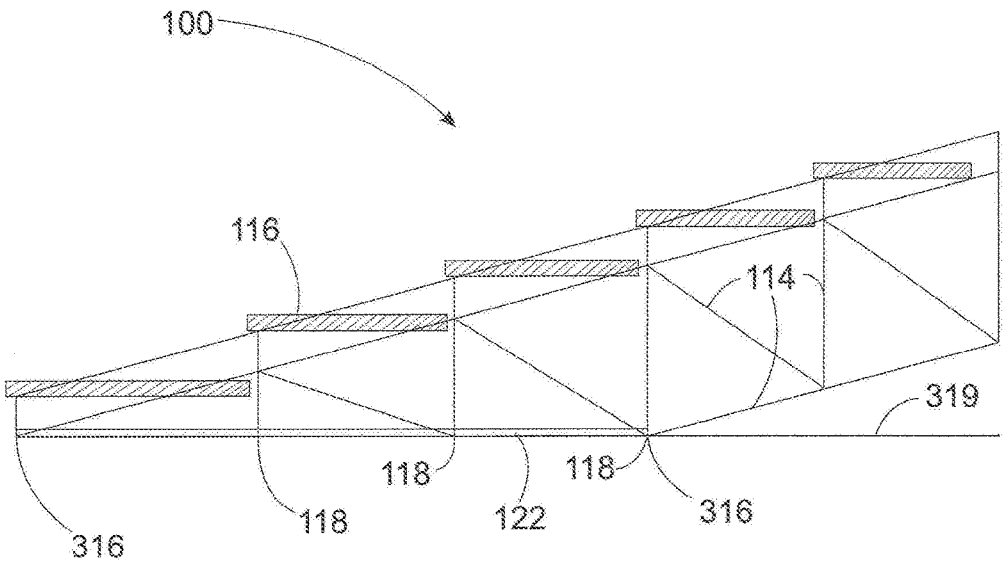
FIG. 5A is a vertical cross section taken along a center of a self-supporting curved staircase coupled to a floor.
Figure 5B:
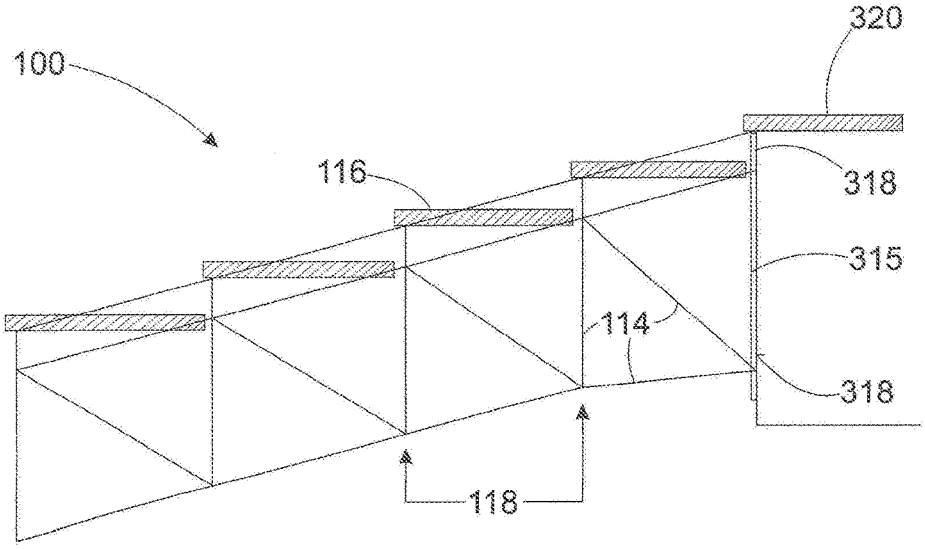
FIG. 5B is a vertical cross section taken along a center of a self-supporting curved staircase coupled to a landing.
Figure 7A:
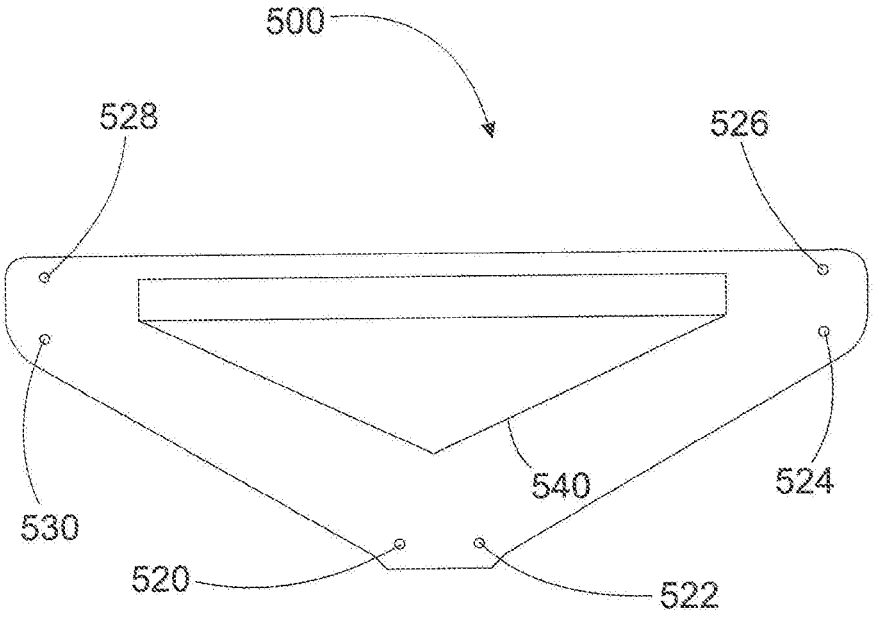
FIG. 7A is a top view of a first mounting plate for mounting a self-supporting curved staircase to a landing.
Figure 7B:
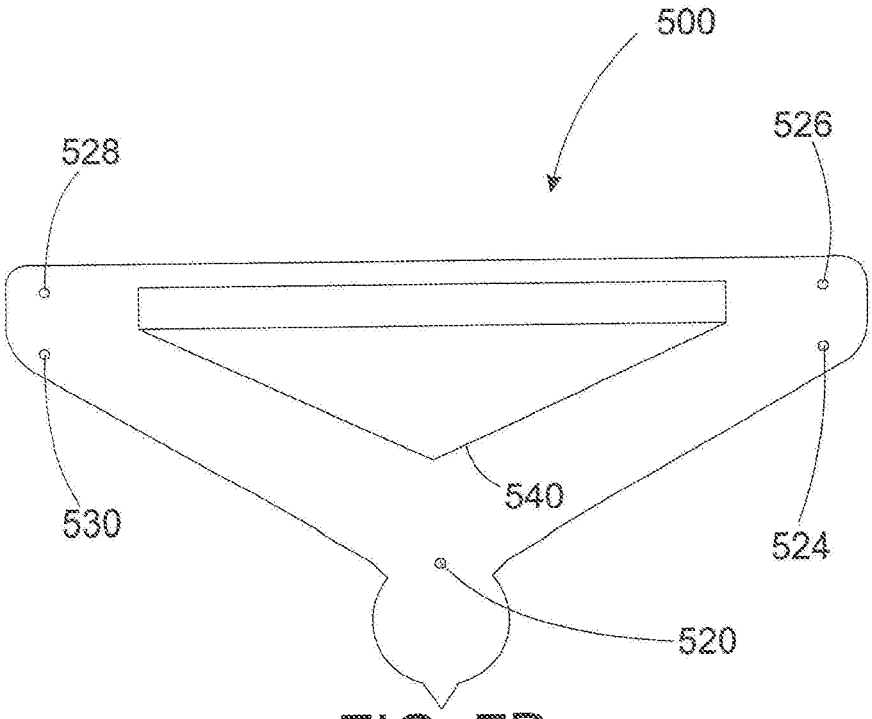
FIG. 7B is a top view of a second mounting plate for mounting a self-supporting curved staircase to a landing.

The top of the curved staircase 100 would be coupled to an upper landing using an upper support plate illustrated in FIGS. 5B, 7A and 7B.

FIG. 2 also illustrates that the curved staircase 100 widens at a lower or bottom portion 124 of the staircase 100. Additionally, the curved staircase 100 widens parallel to the floor at an upper, top or landing portion 126 of the curved staircase 100. In other words, the inner cheek 112 and the outer cheek 110 are farther apart on the bottom few steps and the top few steps. The wider portions at the top 126 and bottom 124 portions of the staircase 100 provide added strength and stability to the structure.

The structure supporting the curved staircase 100 also deepens at the top portion 126 and bottom portion 124 of the staircase 100. In these portions of the staircase 100, the spine 120 is farther from the treads 116 than in the other segments of the staircase 100. This deepening of the support structure of the staircase 100 also adds strength and stability to the staircase 100.

Figure 4:
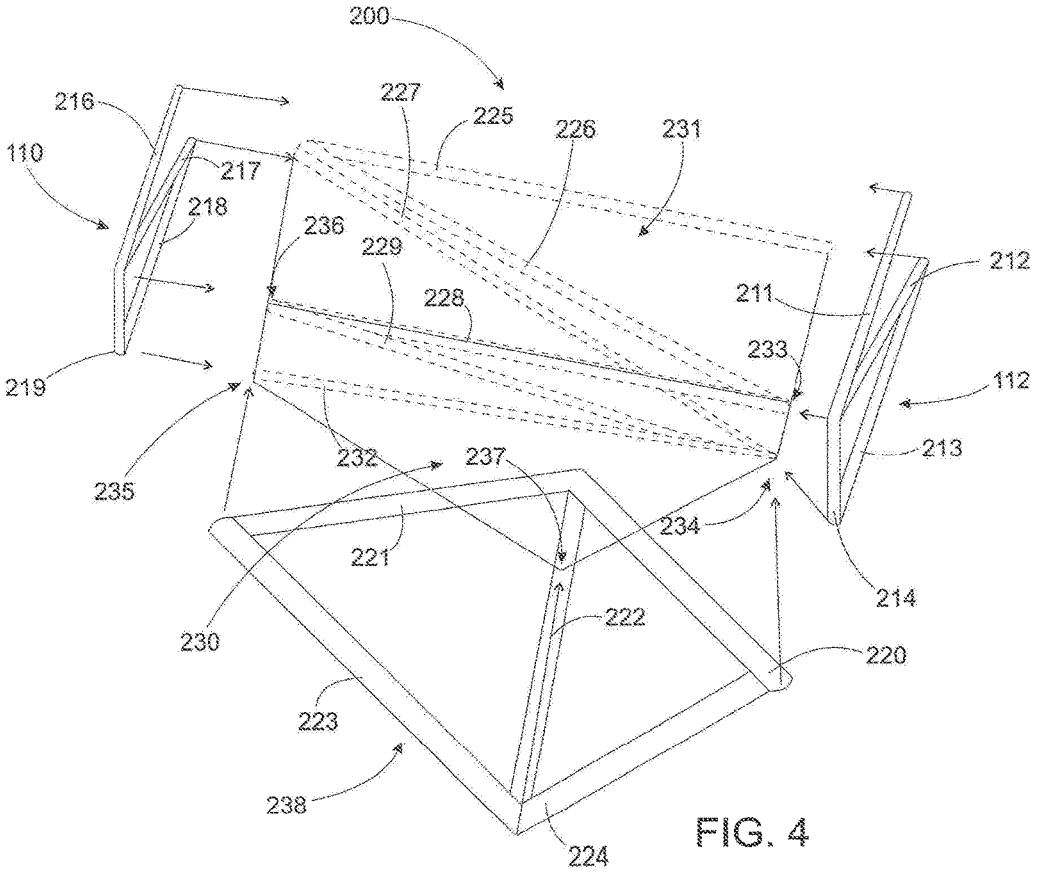
FIG. 4 is a partially exploded view of a stair segment of a first embodiment of a self-supporting curved staircase structure.

FIG. 4 illustrates an embodiment of a stair segment 200 of a first embodiment of a self-supporting curved staircase. Each segment 200 is composed of 18 rods and 5 nodes. Each segment is able to be fabricated and will fit against a lower tread segment for final welding or attachment to the lower segment as well as welding or otherwise coupling of sufficient balusters and handrail to meet building safety codes. Treads will also be coupled to the stair segment 200.

Stair segment 200 includes 18 rods labeled 225, 226, 227, 228, 229, 211, 212, 213, 214, 216, 217, 218, 219, 221, 223, 224, 222, and 220. Rod 232 is a support rod from the back of the previous stair segment 200. The 5 nodes in this figure are labeled 234, 235, 233, 236 and 237.

The segment of the stair is composed of two cheek structures with 4 rods each (the inner cheek 112 composed of rods 211, 212, 213, and 214; and the outer cheek 110 composed of rods 216, 217, 218, and 219). As discussed previously, the cheeks are coupled to the edges of the stair segments 200 on the inside and the outside. Rods 211 and 216 are coupled from the front of the stair segment 200 illustrated to the front of the stair segment 200 above. This causes the cheeks 110 and 112 to create side edges on the treads.

The spine section 238 is coupled to the bottom of the stair segment 200. The spine section is composed of rods 220, 221, 222, 223, and 224. Rod 222 couples to similar rods on other segment sections to form the spine 120 (see FIGS. 1-3). The spine section 238 in FIG. 4 comprises 5 rods. Rod 222 becomes the spine, while rods 220, 221, 223 and 224 extend at an angle downward from the stair segment 200 to support rod 222.

The remaining pieces of the segment 200 are connecting rods 225, 226, 227, 228, and 229. For orientation rods 228, 229, 214, 219, 223, and 224 are in the same vertical plane (as noted by the vertical extent of the plane shown as 230). Rods 225, 226, 228, 217, and 212 are in the horizontal plane shown as 231 under the tread itself. Rod 232 from the lower segment which is the alignment and connecting rod to the newer segment. Planes 230 and 231 are included for illustrative purposes only and are not actual physical surfaces.

Each segment has 5 nodes 233, 234, 235, 236, and 237 which are the 5 corners of the vertical plane of the front of the segment. Nodes 233, 234, 235, and 236 are determined by the geometry of the stair dimensions. Node 237 is a variable height from rod 232 which is determined by structural analysis for strength and rigidity of the structure in large diameter curved stairs.

As illustrated in the figures, the tetrahedral structure in the disclosed staircase is not formed from equilateral tetrahedrons, instead the tetrahedral structure is a skewed tetrahedral structure wherein the lengths of the legs of the tetrahedrons or the proportions of some of the lengths of the legs of the tetrahedrons to the remaining legs of the tetrahedrons have been altered in order to form a curved or helix. As the proportions of the lengths of the legs of the tetrahedrons change, the shape and curvature of the curved staircase are altered.

FIGS. 5A and 5B are vertical sections through the stair near the center of the stair showing the main stair elements, the spine, and how the stairs are attached to the floor as shown in FIG. 5A and how the stair is attached to the upper building structure as shown in FIG. 5B. FIG. 5A shows the vertical section through the bottom 5 tread segments of the stair. FIG. 5A shows bottom metal plate 122, attachment points 316 to floor structure 319, and typical treads 116. Rods 114 act as spine elements. The last 3 stair segments have nodes 118 which touch floor structure 319. The bottom two steps could be splayed outward to add additional strength to the stair. The spine structure may contact the bottom metal plate 122 for three or more stair segments.

FIG. 5A illustrates a bottom portion of a self-supporting curved staircase 100. The bottom portion of the curved staircase 100 is coupled to floor 319. Floor 319 is the surface to which the lowest end of the curved staircase 100 is coupled. Curved staircase 100 is coupled to floor 319 by bottom support plate 122.

Bottom support plate 122 is a metal plate to which the support structure of the curved staircase 100 is coupled. The support structure 100 may be coupled to the bottom support plate 122 through bolts, screws, welding, adhesive, epoxy or the like. Provided that the connection is strong enough to withstand the forces applied to the curved staircase 100 during use.

The bottom support plate 122 is coupled to floor 319 through couplers 316. Couplers 316 may be screws, bolts, clips, nail, adhesive or the like. Couplers 316 may be any device or substance that can securely attach the bottom support plate 122 to the floor 319 surface. Provided that the connection is strong enough to withstand the forces applied to the curved staircase 100 during use. Additionally, as many or as few couplers 316 may be used to couple to the bottom support plate 122 to the floor 319 as is desired or necessary to secure the bottom support plate 122 to the floor 319.

Figure 6:
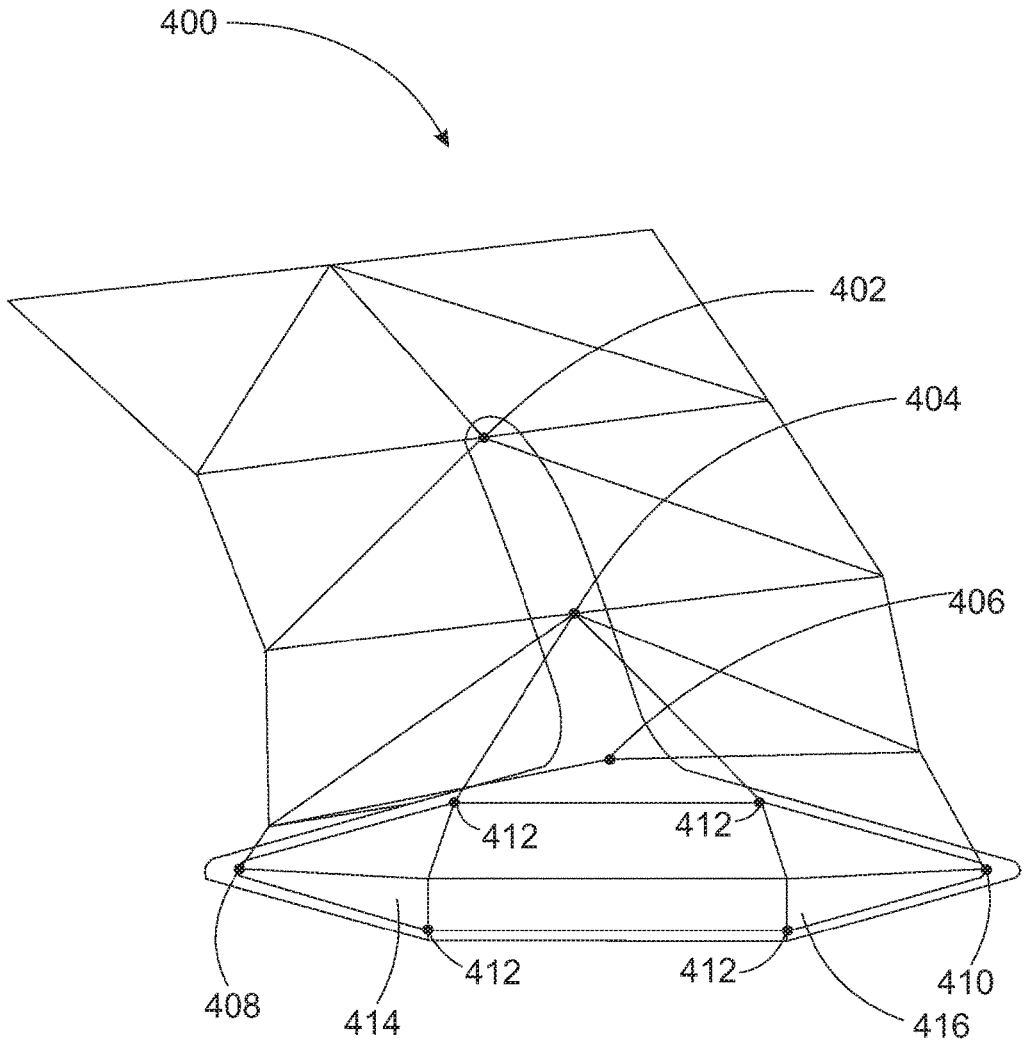
FIG. 6 is a top view of a self-supporting curved staircase coupled to a floor.

FIG. 6 illustrates and embodiment of a bottom support plate 400. The metal plate 414 is shaped with a wide end 416 which supports the lowest stair of the curved staircase. The metal plate 414 narrows towards the other end which is used to support the next few stair segments. The wide end 416 of the bottom support plate 400 may be shaped as an elongated diamond or else the bottom support plate 400 may be formed in any shape desired, provided that the bottom support plate 400 is strong enough and large enough to support the curved staircase and that the bottom support plate 400 does impede with the architecture of the building if at all possible.

FIG. 6 also illustrates rods from the curved staircase coupled to the bottom support plate 400 at nodes 402, 404, 406, 408, 410, and 412. The rods may be welded, bolted, or coupled to the bottom support plate 400 with adhesive or the like. Additionally, the rods may be screwed into threaded female receivers formed in the bottom support plate 400.

While the bottom support plate 400 illustrated in FIG. 6 is one possible shape of a bottom support plate 400, FIG. 3 illustrates an alternatively shaped bottom support plate 122. Additionally, the bottom support plate may be shaped in anyway desired, so long as it serves its purpose. The bottom support plate may also be formed from any material desired, provided it can be coupled to the curved staircase 100 and has enough strength to couple the curved staircase 100 to the floor.

FIG. 5B shows a vertical section through the top 4 stair treads 116 and second floor landing 320. At the top of the stair 100 where the stair 100 is attached to the building, nodes 118 for the top two or more stair segments would be deepened and/or split to form a triangular shape to add additional strength and rigidity to the stair (rods 114 are the typical spine rods of the stair structure). In addition the top two stair segments could be splayed to add to the strength and rigidity of the stair. Attachment of the top of the stair would have the top segment rods welded or otherwise coupled to a metal plate 315 so as to distribute the stresses of the stair onto the supporting building structure 320.

FIGS. 7A and 7B show two different upper support plates 500 which are used to mount the top of the staircase to the upper landing 320 (see FIG. 5B). FIG. 7A illustrates an upper support plate 500 which splays out the upper 1 or 2 stair segments making them wider. FIG. 7B illustrates an upper support plate 500 that supports the stairs by lowering node 118 (see FIG. 5B) and coupling it to the side of the upper landing.

FIG. 7A illustrates an upper support plate 500 formed in the shape of a triangle with a flat top. With additional reference to FIG. 5B, the upper support plate 500 is a flat metal plate that is mounted to the upper landing 320 and to which the staircase is coupled. In the embodiment illustrated in FIG. 7A, node 118, which is the node at the bottom or along the spine of the staircase is split or bifurcated in order to provide additional support to the staircase. The bifurcated node 118 is coupled to the upper support plate 500 at locations 520 and 522. The inner cheek and outer cheek of the staircase are coupled to the upper support plate 500 at locations 524, 526, 528 and 530. Thereby, securing the staircase to the upper support plate 500 which is secured to the upper landing 320. Outline 540 illustrates the shape of a normal stair before the stair is flared out in order to couple to locations 520, 522, 524, 526, 528 and 530. The flared stair increases structural strength of the staircase and is aesthetically pleasing.

FIG. 7B illustrates an upper support plate 500 formed in the shape of an upside down triangle. With additional reference to FIG. 5B, the upper support plate 500 is a flat metal plate that is mounted to the upper landing 320 and to which the staircase is coupled. In the embodiment illustrated in FIG. 7B, node 118, which is the node along the spine of the staircase, is coupled to the upper support plate 500 at location 520. The inner cheek and outer cheek are coupled to the upper support plate 500 at locations 524, 526, 528 and 530. Outline 540 illustrates the shape of a normal stair before the stair is flared out in order to couple to locations 520, 524, 526, 528 and 530. The flared stair increases structural strength of the staircase and is aesthetically pleasing.

The staircase may be coupled to the upper support plate 500 by screws, bolts, welding, epoxy, adhesive or the like.

The upper support plate 500 may be formed in any size or shape desired, i.e., circular, oval, rectangular, square and the like. Additionally, any artistic embellishment desired may be added, so long as it does not impede the strength and purpose of the upper support plate 500.

The upper support plate 500 may also be formed from any material desired, so long as the upper support plate 500 is strong enough to support the weight of the curved staircase when it is in use. It is likely that a thin metal plate formed in various shapes will be most often used as an upper support plate 500.

Figure 8:
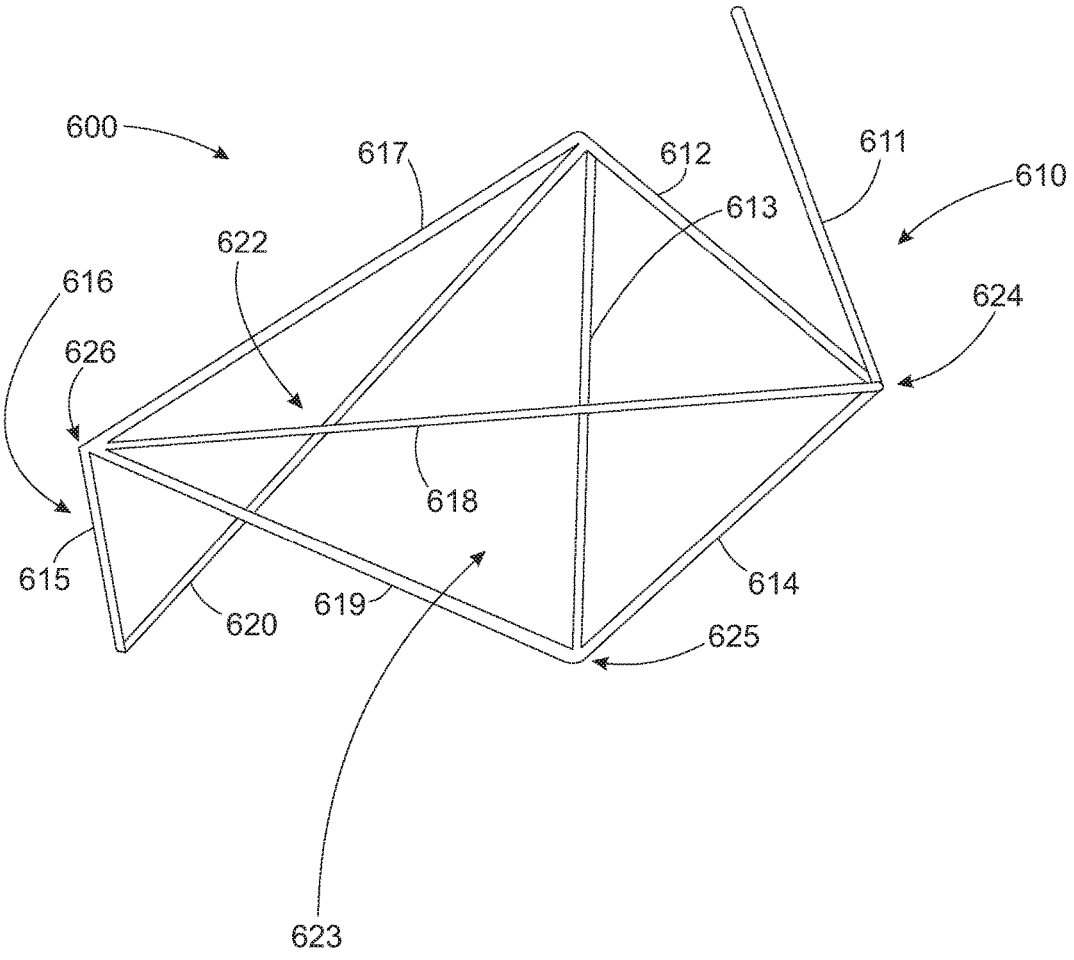
FIG. 8 is an isometric view of a stair segment of a second embodiment of a self-supporting curved staircase.

FIG. 8 shows an isometric view of an alternate embodiment of a stair segment 600. Stair segment 600 has 9 rods per tread 611, 612, 613, 614, 615, 617, 618, 619, and 620 with 3 connecting nodes 624, 626, and 625 arranged in a tetrahedral structure for curved stairs that are of a smaller diameter, particularly an outside diameter in the range of from about 4 feet to about 10 feet.

Node 625 is the spine node and it, in combination with rod 613, are coupled to the spine node and rod from other steps to form the spine along the underside of the self-supporting curved staircase.

The stair segment 600 comprises an outer cheek 610 with 4 rods 611, 612, 613, and 614, arranged in a sloped manner. Rod 611 extends from the front of stair segment 600 to the front of the next stair segment above. Rods 612, 613, and 614 are coupled in a triangular shape.

Inner cheek 616 is comprised of only rod 615. Rod 615 of inner cheek 616 is sloped to go from the front of the lower step to the rear of the step it is a part of.

There are 4 lateral rods connecting inner cheek 616 and outer cheek 610. The 4 lateral connecting rods are 617, 618, 619, and 620. Additionally, rod 620 inter connects two stair segments. Plane 622 shows the location of the tread which is supported by rods 617, 618, and 612, and plane 623 shows the surface of the vertical step element structure formed by rods 619, 618 and 614. Planes 622 and 623 are included for illustrative purposes only and are not actual physical surfaces.

Figure 9:
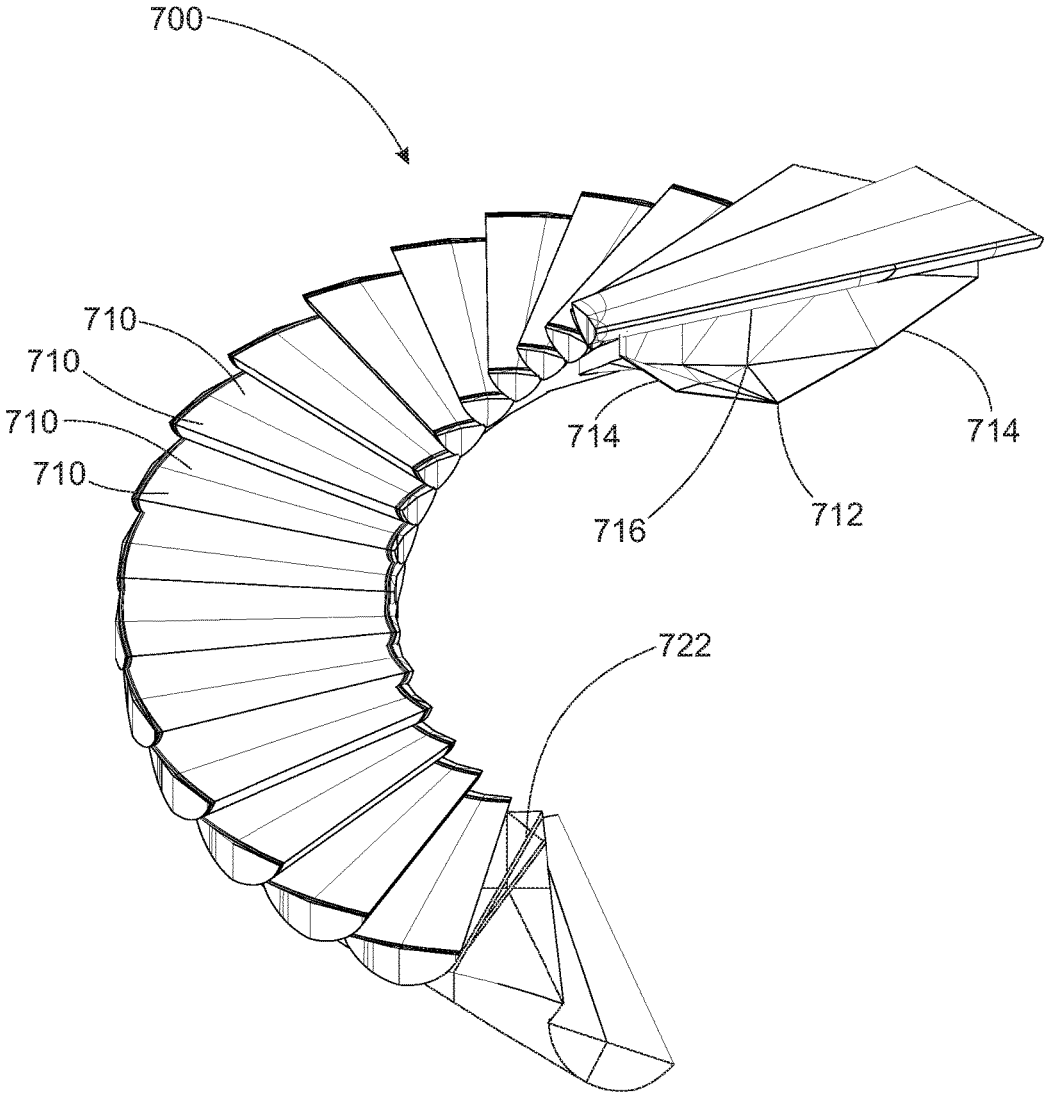
FIG. 9 is an isometric view of a third embodiment of a self-supporting curved staircase.
Figure 10:
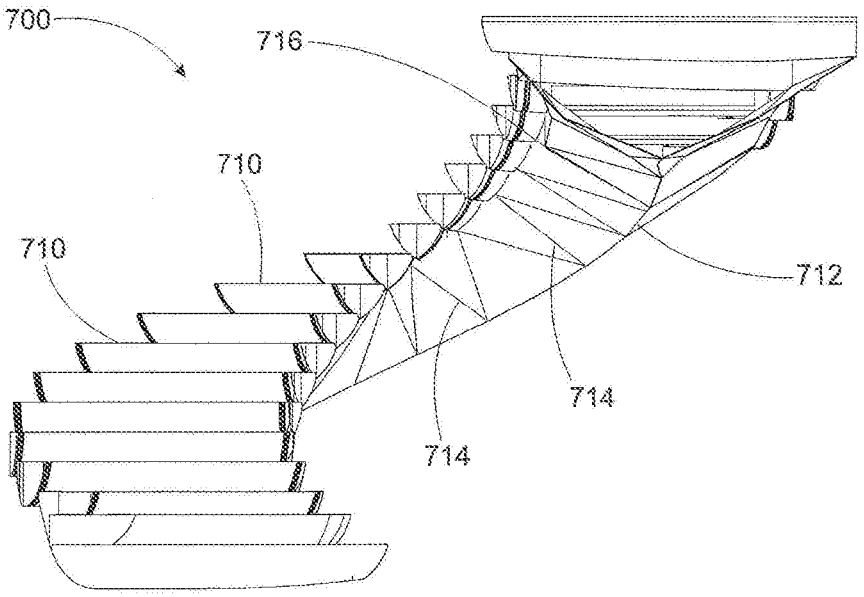
FIG. 10 is a front view of a third embodiment of a self-supporting curved staircase.
Figure 11:
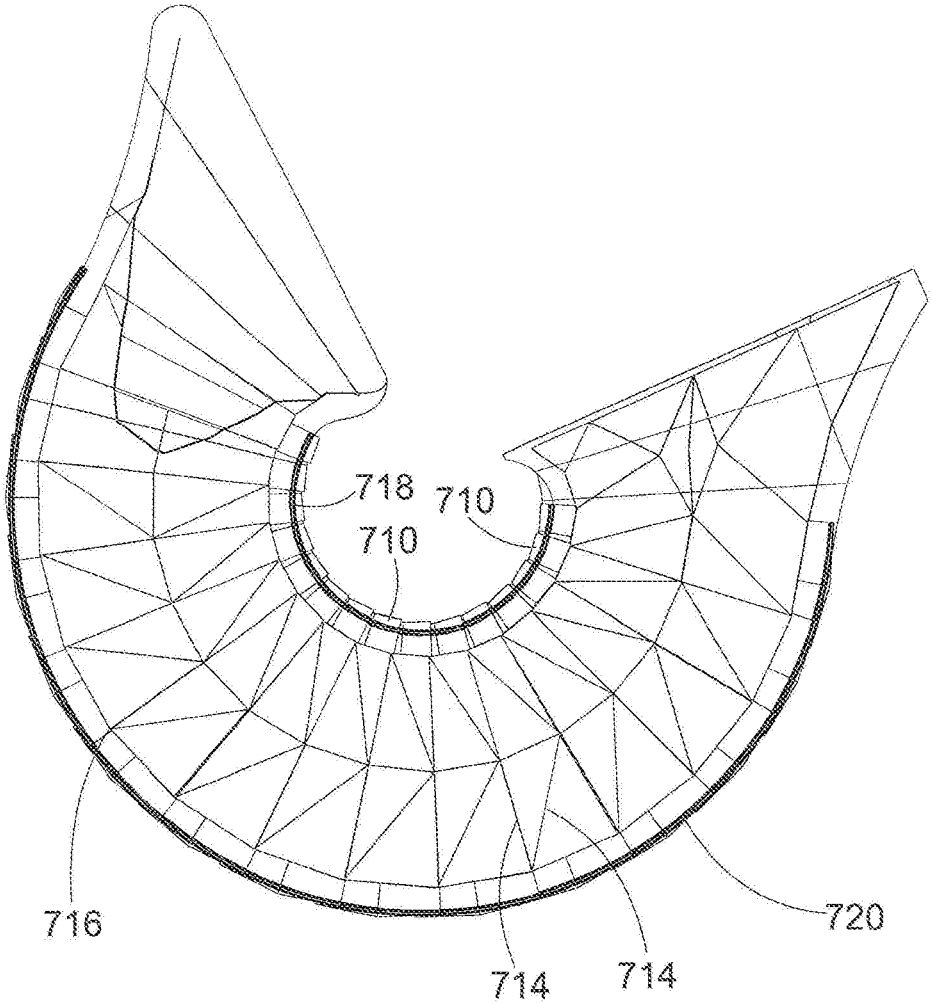
FIG. 11 is a bottom view of a third embodiment of a self-supporting curved staircase.

FIGS. 9-11 illustrate an alternate embodiment of a self-supporting curved staircase 700 formed from sheet metal and internal stiffening rods, similar to the rods in previous embodiments. As in previous embodiments, this embodiment includes a plurality of linear support locations 714. In previous embodiments, these linear supports were rods. In this configuration, however, the rods of the underbody structure are replaced with creases in the sheet metal used to form the curved staircase 700. Both the 18 rod and 9 rod configurations may be used with the sheet metal curved staircase 700.

The linear support locations 714 may be slight creases in the sheet metal, where the angle formed by the crease is obtuse. Alternately, the linear support locations 714 may be formed as acute angles in the sheet metal, depending on the desired configuration.

Additionally, a spine 712 is also formed in the sheet metal in order to increase the strength of the curved staircase 700.

An outer cheek 718 and an inner cheek 720 are also formed by bending the sheet metal parallel to the tread location of the curved staircase 700.

Treads 710 are placed on top of the sheet metal structure with the treads 710 overlapping and hiding the outer cheek 718 and inner cheek 720. The treads 710 may be formed in any shape or size desired. Additionally, the treads 710 may be formed from any material desired.

The treads 710 may also, as illustrated, be formed from two pieces which are coupled parallel one another on the sheet metal structure.

The treads 710 may be flat and sit on top of the inner cheek 720 and the outer cheek 718, or the treads 710 may have a lip which overlaps the cheeks.

The treads 710 may be coupled to the sheet metal structure through screws, bolts, adhesives or the like.

The creases or linear support locations 714 meet at nodes 716 similarly to the rods in previous embodiments. Nodes 716 are indentations in the sheet metal where multiple linear support locations 714 end.

Additionally, stiffening rods 722 may be placed inside the sheet metal structure to add strength and stiffness to the curved staircase 700. The stiffening rods 722 are coupled between the inner cheek 718 and the outer cheek 720 of the sheet metal staircase. The stiffening rods 722 may be metal rods, metal tubes, wooden dowels, panels or the like.

The sheet metal self-supporting curved staircase 700 may also widen at a top and bottom portion of the staircase 700 in order to add additional strength and stability to the staircase 700.

Figure 12:
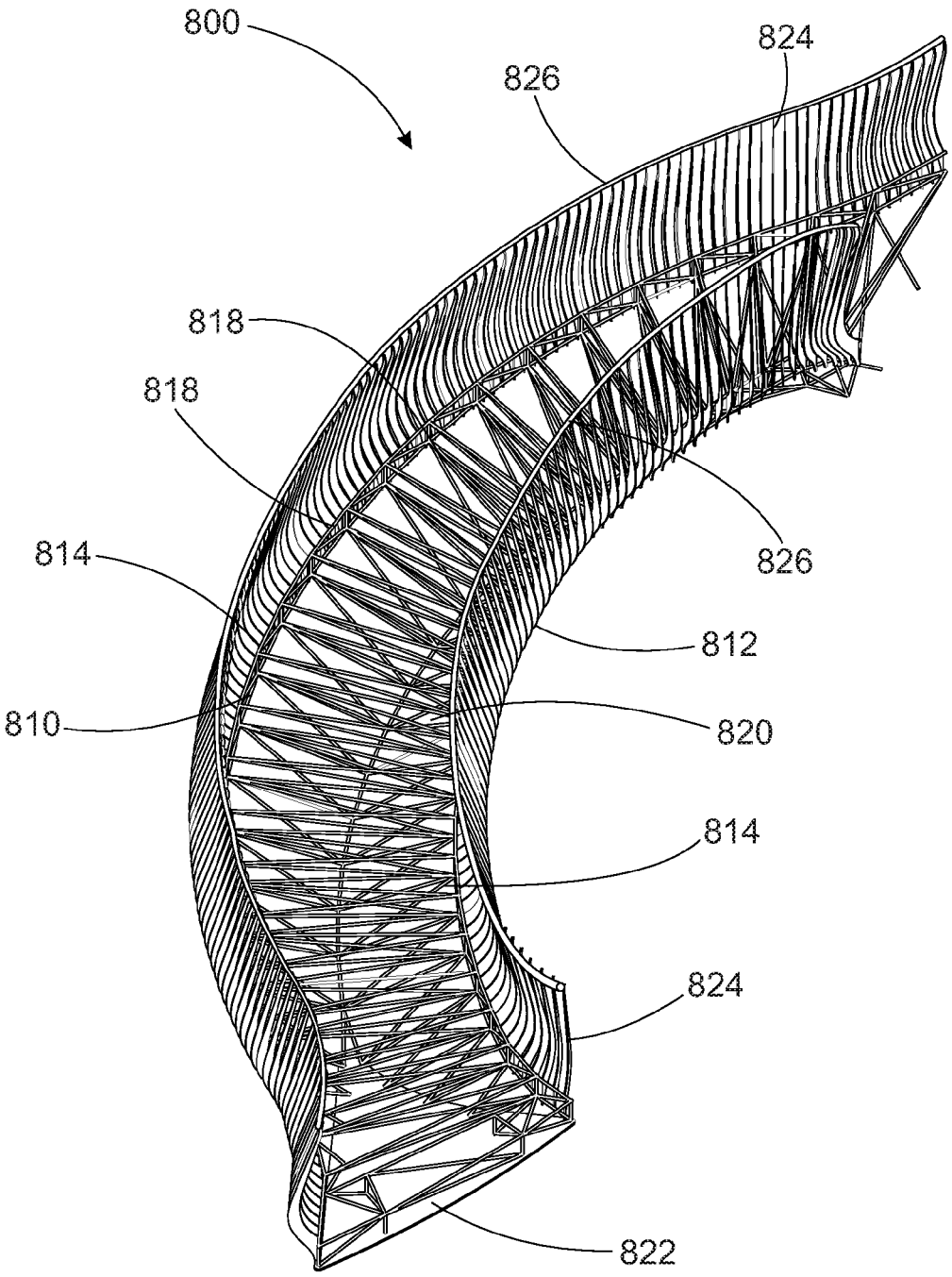
FIG. 12 is an isometric view of an embodiment of a self-supporting curved staircase structure with a railing.
Figure 13:
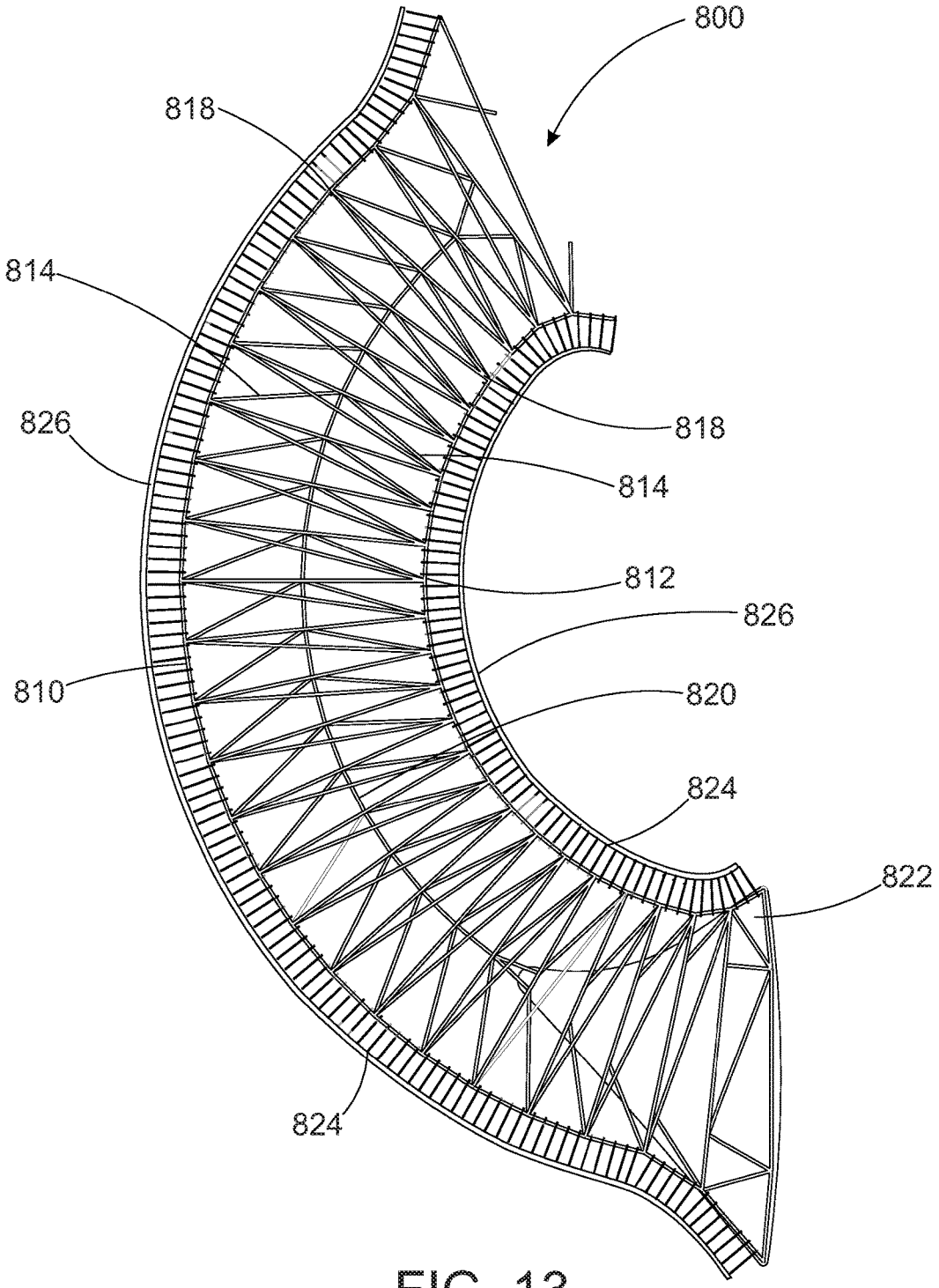
FIG. 13 is a top view of an embodiment of a self-supporting curved staircase structure with a railing.

FIGS. 12-13 illustrate an additional embodiment of a self-supporting curved staircase 800. The curved staircase 800 includes rods 814 and nodes 818 that are similar to and provide similar function as previously discussed with regard to rods 114 and nodes 118. Additionally, the staircase 800 includes a spine 820 formed by the rods 814 and nodes 818. The curved staircase 800 also includes a bottom support plate 822 identical to those previously discussed. An upper support plate would be used to couple the self-supporting curved staircase 800 to an upper landing as described previously.

In this embodiment, however, the inner cheek 812 and outer cheek 810 have balusters 824 coupled along them. These balusters 824 may be formed in any shape desired. The balusters 824 illustrated are curved metal strips which bow out at the bottom and taper towards the center of the staircase at the top. The balusters 824 provide added strength and stability to the overall curved staircase structure 800.

The balusters 824 have a railing 826 coupled along a location near the top of the balusters. The railing 826 may be formed from metal, wood, glass or the like. The railing 826 may have a cross-section that is circular, square, rectangular or may have a decorative shape. The railing 826 also increases the strength of the staircase 800.

The railing 826 may be coupled to the balusters 824 by welding, screws, bolts, adhesives, epoxies or the like. Provided the method of coupling the railing 826 to the balusters 824 is sufficiently strong to prevent the railing 826 from coming loose.

FIG. 13 is a top view of a curved staircase 800 with balusters 824 and a railing 826. As illustrated in this figure, the curved staircase 800 may widen at a top and bottom location in order to increase the strength and stability of the staircase 800.

In alternate embodiments of a self-supporting curved staircase with balusters and a railing, artwork may be applied to the treads and/or balusters. Portions of the artwork may be applied to each tread or each baluster in order to allow the user to see the entire image from a distance.

The structure described in this application with respect to curved staircases may also be applied to other curved structures such as curved ramps, curved rooftops and the like and the description herein should not be limited to staircases.

The curved staircases described above may also be formed in many different ways. The curved staircase may be welded, bolted, epoxied or the like. Additionally, the curved staircase may be formed with a 3d printer, wherein the **3*d*** printer would form the staircase from metal, polymers or other materials which are strong enough to meet the structural demands of the staircase.

The curved staircases disclosed herein may be formed from any material desirable. Examples of materials include wood, glass, metal, polymers, plastics, carbon fiber, fiberglass, composites and the like. Additionally, the staircases described herein may be formed from multiple types of materials, i.e. the stair tread may be formed from glass while the rods may be formed from metal or carbon fiber and the upper support plate and floor plate may be formed from wood or metal.

Additional embodiments of the curved staircases disclosed above may be formed with from fewer or greater numbers of rods and nodes, so long as those rods form tetrahedral structures such as those discussed above. Therefore, though the figures disclose a certain number of rods and nodes, the figures were included for exemplary purposes only and are not meant to be limiting in anyway.

Alternate embodiments may also include the stair case being formed from sheet goods, i.e. sheet metal, plastic sheeting, or the like. The sheet goods would be used to form the tetrahedral planes of the structure. Solid materials, i.e. foam, plastic, concrete, foam coated with fiberglass or the like, may also be used to form the stair case. Solid materials would be used to follow the shape of the described stair in either a single form or post tensioned stair segments.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

What is claimed:

1. A self-supporting curved staircase comprising:

a plurality of stair segments, wherein each of said stair segments comprises a plurality of rods coupled to a plurality of connecting nodes;

wherein said plurality of rods are arranged in a skewed tetrahedral geometry, said skewed tetrahedral geometry causes said plurality of stair segments to form a curved structure when said plurality of stair segments are coupled together;

wherein said plurality of rods form a spine on an underside of said plurality of stair segments; and a tread coupled to each of said stair segments.

2. The self-supporting curved staircase of claim 1, each of said plurality of stair segments further comprising 18 rods and 5 connecting nodes.

3. The self-supporting curved staircase of claim 1, wherein at least one of said plurality of stair segments is coupled to a support plate.

4. The self-supporting curved staircase of claim 3, wherein said support plate is coupled to a floor.

5. The self-supporting curved staircase of claim 3, wherein said support plate is coupled to a landing at an upper level.

6. The self-supporting curved staircase of claim 1, wherein each of said plurality of stair segments further comprises an inner cheek and an outer cheek; and wherein said inner cheek and said outer cheek are farther apart at a bottom portion of said curved staircase than at a middle portion of said curved staircase.

7. The self-supporting curved staircase of claim 1, wherein each of said plurality of stair segments further comprises an inner cheek and an outer cheek; and wherein said inner cheek and said outer cheek are farther apart at a top portion of said curved staircase than at a middle portion of said curved staircase.

8. The curved staircase of claim 1, wherein said curved staircase is anchored at a lower level floor and at an upper level floor, wherein said curved staircase is self-supporting.

9. A self-supporting curved staircase comprising:

a support structure, wherein said support structure comprises a plurality of segments having at least 9 rods coupled to at least 3 connecting nodes;

wherein said at least 9 rods and said at least 3 connecting nodes form a tetrahedral geometry;

wherein said tetrahedral geometry causes each of said plurality of segments to have a non-symmetrical shape;

wherein when said plurality of segments are coupled together said non-symmetrical shape causes said plurality of segments to form a helical support structure; and a plurality of treads coupled to said support structure.

10. The self-supporting curved staircase of claim 9, wherein at least one of said plurality of stair segments is coupled to a support plate.

11. The self-supporting curved staircase of claim 10, wherein said support plate is coupled to a floor.

12. The self-supporting curved staircase of claim 10, wherein said support plate is coupled to a landing at an upper level.

13. The self-supporting curved staircase of claim 9, wherein each of said plurality of segments further comprises an inner cheek and an outer cheek; and wherein said inner cheek and said outer cheek are farther apart at a bottom portion of said curved staircase than at a middle portion of said curved staircase.

14. The self-supporting curved staircase of claim 9, wherein each of said plurality of segments further comprises an inner cheek and an outer cheek; and wherein said inner cheek and said outer cheek are farther apart at a top portion of said curved staircase than at a middle portion of said curved staircase.

15. A self-supporting curved staircase comprising:

a support structure comprising a plurality of linear support locations coupled at a plurality of connecting nodes;

wherein said plurality of linear support locations and said plurality of connecting nodes form a plurality of tetrahedrons;

wherein said plurality of linear support locations and said plurality of connecting nodes form a spine on an underside of said self-supporting curved staircase; and a plurality of treads coupled to said support structure.

16. The self-supporting curved staircase of claim 15, wherein said plurality of linear support locations and said plurality of connecting nodes are formed as creases in sheet metal.

17. The self-supporting curved staircase of claim 15, wherein said plurality of tetrahedrons are modified so as to cause said support structure to form a helix.

18. The self-supporting curved staircase of claim 15, wherein said support structure comprises a plurality of segments and wherein each of said plurality of segments comprises at least 9 linear support locations and at least 3 connecting nodes.

19. The self-supporting curved staircase of claim 15, wherein said support structure further comprises an inner cheek and an outer cheek; and said inner cheek and said outer cheek are farther apart at a bottom portion than at a middle portion of said support structure.

20. The self-supporting curved staircase of claim 15, wherein said support structure further comprises an inner cheek and an outer cheek; and said inner cheek and said outer cheek are farther apart at a top portion than at a middle portion of said support structure.

* * * * *